US012405084B2

(12) United States Patent
Pastusek et al.

(10) Patent No.: US 12,405,084 B2
(45) Date of Patent: Sep. 2, 2025

(54) SIGHT INSTALLATION AND REMOVAL TOOL

(71) Applicant: XS Sight Systems, Inc., Fort Worth, TX (US)

(72) Inventors: Jonathan Pastusek, Fort Worth, TX (US); William Wallace, Fort Worth, TX (US); Monte Long, Fort Worth, TX (US); William Cobb, Fort Worth, TX (US); Michael Pastusek, Fort Worth, TX (US); Zackary Kinsley, Fort Worth, TX (US)

(73) Assignee: XS Sight Systems, Inc., Fort Worth, TX (US)

( * ) Notice: Subject to any disclaimer, the term of this patent is extended or adjusted under 35 U.S.C. 154(b) by 0 days.

(21) Appl. No.: 18/324,653

(22) Filed: May 26, 2023

(65) Prior Publication Data

US 2023/0384056 A1 Nov. 30, 2023

Related U.S. Application Data

(60) Provisional application No. 63/365,421, filed on May 27, 2022.

(51) Int. Cl.
*F41G 1/54* (2006.01)
*F41G 1/22* (2006.01)

(52) U.S. Cl.
CPC ..... *F41G 1/22* (2013.01); *F41G 1/545* (2013.01)

(58) Field of Classification Search
CPC ..... F41G 1/54; F41G 1/545
See application file for complete search history.

(56) References Cited

U.S. PATENT DOCUMENTS

| | | | | |
|---|---|---|---|---|
| 2,599,839 | A * | 6/1952 | Keifer, Jr. | F41G 1/26 254/98 |
| D335,805 | S * | 5/1993 | Ransom | D8/51 |
| 5,864,957 | A * | 2/1999 | Small | F41G 1/54 42/134 |
| 8,316,573 | B2 * | 11/2012 | Bietsch | F41G 1/545 33/274 |
| 8,397,422 | B2 * | 3/2013 | Bietsch | F41G 1/545 33/274 |
| 8,707,609 | B2 * | 4/2014 | Fisher | F41C 27/00 33/274 |
| 8,910,413 | B2 * | 12/2014 | Hillwig, Jr. | F41G 1/545 42/143 |

(Continued)

FOREIGN PATENT DOCUMENTS

CN 117053630 A * 11/2023

*Primary Examiner* — Gabriel J. Klein
(74) *Attorney, Agent, or Firm* — Wood Herron & Evans LLP

(57) ABSTRACT

A sight installation device, comprising a body having a notch which is capable of receiving a pistol slide with a sight receiving groove, the notch possessing a first and a second lateral sidewall, and an at least one horizontal brace abutment. The sight installation device's body also has at least one guide channel proximate the notch, in which a pusher bit is longitudinally slidable and configured so as to contact a sight element directly in line with the pistol slide's sight-receiving groove. The sight installation device also possesses a drive screw configured to engage an opening in the body proximate the guide channel, the drive screw engaging the opening and configured to engage the pusher bit.

21 Claims, 10 Drawing Sheets

(56) References Cited

U.S. PATENT DOCUMENTS

| | | | | |
|---|---|---|---|---|
| 9,464,870 | B2 * | 10/2016 | Gomez | F41G 1/545 |
| 9,593,910 | B1 * | 3/2017 | Fisher | F41G 1/545 |
| 9,784,535 | B1 * | 10/2017 | Cheng | F41G 1/545 |
| 9,869,529 | B2 * | 1/2018 | Gomez | F41G 1/545 |
| 10,955,219 | B1 * | 3/2021 | Morris | F41G 1/545 |
| 11,199,378 | B2 * | 12/2021 | LoRocco | F41G 1/545 |
| 11,226,174 | B1 * | 1/2022 | Chen | F41G 1/545 |
| 12,018,916 | B1 * | 6/2024 | Morris | F41G 1/545 |
| 2011/0167702 | A1 * | 7/2011 | Bietsch | F41G 1/545 254/1 |
| 2011/0252688 | A1 * | 10/2011 | Bietsch | F41G 1/545 42/90 |
| 2011/0314719 | A1 * | 12/2011 | Tripp | B25B 13/56 42/108 |
| 2013/0255128 | A1 * | 10/2013 | Fisher | F41G 1/545 42/108 |
| 2014/0230304 | A1 * | 8/2014 | Hillwig, Jr. | F41G 1/545 42/90 |
| 2018/0128569 | A1 * | 5/2018 | Williams | F41A 29/02 |
| 2018/0172385 | A1 * | 6/2018 | Hale | A47B 37/00 |
| 2020/0400407 | A1 * | 12/2020 | LoRocco | F41G 1/545 |
| 2021/0364253 | A1 * | 11/2021 | Chen | F41G 1/545 |
| 2022/0074703 | A1 * | 3/2022 | Jacobson | B25B 13/56 |
| 2023/0266101 | A1 * | 8/2023 | Alsheuski | F41G 11/001 42/90 |
| 2023/0384056 | A1 * | 11/2023 | Pastusek | F41G 1/545 |

* cited by examiner

SIGHT INSTALLATION AND REMOVAL TOOL

RELATED APPLICATION

This application is a non-provisional application of provisional patent Application No. 63/365,421, filed May 27, 2022, the entirety of which is incorporated herein by reference.

TECHNICAL FIELD

This invention relates to a tool apparatus for installing, removing, and/or adjusting firearm sights, particularly rear sights on handgun slides.

BACKGROUND

Sights are used in various firearms to enhance the user's ability to more accurately identify and strike a target. Sights are typically comprised of a rear sight and a front sight which are both mounted to the firearm and work in tandem to aid the shooter. Sights may be variably configured depending on their manufacturer and their intended uses. For example, sights used on a handgun may possess a different overall shape than sights used on a rifle, and the way in which various sights (including both front and rear) are mounted to a firearm may also differ.

Rear sights are situated near the rear of the firearm, i.e., closest to the user. For a handgun, the rear sight will usually be placed or mounted on the top of the slide above the grip. Adjustable rear handgun sights are usually mounted in a dovetail groove cut transversely into the top surface of a handgun slide. The present invention particularly relates to a tool used to install, remove, and/or adjust handgun sights so each ensuing reference to a firearm sight should be understood to be particularly pertinent to handgun sights. The rear sight fits tightly into the dovetail groove so that it does not move unintentionally and requires significant force to displace. The rear sight element can be tapped into place or removed using a hammer and punch tool, for example. However, this method of installation and/or removal risks damaging the rear sight and/or handgun slide. By tapping the rear sight too hard, or imprecisely, the rear sight may get dented or reshaped in a way that impedes proper mounting. The same may also occur with respect to the mounting groove found on the handgun slide. Also, mounting and/or removing the rear sight using a hammer and punch tool makes adjustments to the rear sight's placement difficult and imprecise. Proper placement of the rear sight is critical because it must act in tandem with the front sight to pinpoint the target. If the rear sight is misaligned, it will distort the user's aim and result in inaccurate shots. A hammer and punch tool make precise, incremental movements of the rear sight very difficult to achieve. But precise, incremental movements are necessary in order to properly align the rear sight with the front sight.

A variety of special tools and fixtures also are available for mounting and/or removing a rear sight from a handgun, but available models have certain limitations. Typically, the available models include a frame that surrounds the handgun slide and adjustably clamps the handgun slide into place. For example, U.S. Pat. No. 11,199,378 to LoRocco et al. ("LoRocco"), U.S. Pat. No. 11,226,174 to Chen ("Chen"), U.S. Pat. No. 8,910,413 to Hillwig, Jr. ("Hillwig"), U.S. Pat. No. 9,784,535 to Cheng et al. ("Cheng II"), U.S. Pat. No. 10,955,219 to Morris ("Morris"), U.S. Pat. No. 9,593,910 to Fisher ("Fisher"), U.S. Pat. No. 9,464,870 to Gomez ("Gomez"), U.S. Pat. No. 8,707,609 to Fisher ("Fisher II"), and U.S. Pat. No. 9,869,529 to Gomez ("Gomez II") are prior art that generally possess a frame for inserting the handgun slide and an adjustable clamp that secures the handgun slide in place in order to tap out and/or remove the rear sight; Hillwig is illustrative. In Hillwig, the user may clamp the handgun slide into the block member whereby a jaw member bears against the sight element when urged, i.e., tapped, by the pushing member. In other words, transverse movement of the rear sight is accomplished with a bit that contacts portions of the rear sight that extend upwardly above the top surface of the handgun slide. However, such tools suffer from particular drawbacks which can ultimately lead to damage to the rear sight, the handgun slide, or both. In prior art sight removal tools such as Hillwig, a disproportionate force vector (moment arm) is created as a result of the moving force applied a distance above and offset from the resistance force. In other words, while a lateral force against the uppermost portion of the rear sight is exerted in order to move the entire rear sight from the handgun slide, a latent, opposite force is exerted against the lowermost portion of the rear sight by the mounting groove, causing the same piece, i.e., the rear sight, to possess conflicting force vectors in close proximity. An even longer force vector is created when the force driving the bit (typically a threaded screw drive) is even further above and offset from both the point of contact between the bit and the sight element and the resistance force. A longer force vector requires a greater conflicting force to (re)move the sight element and applies strain to the upward projections of the sight element. It also makes fine adjustments more difficult. These shortcomings can have detrimental effect on the operational capabilities of the rear sight. These shortcomings can also affect the long-term durability of the rear sight.

Prior art tools such as LaRocca, Chen, Hillwig, Cheng, Morris, Gomez, Fisher, and Gomez II also suffer from spatial limitations which make certain types of handgun slides and rear sights impossible to use therewith. It is common in the art, as exemplified by the foregoing references, to clamp the handgun slide within a block or frame in order to secure it from all directions, i.e., from the top, bottom, and sides. Each member of the prior art frames (e.g., the top, bottom, and side members) are fitted with adjustable bolts, rods, screws, or the like. But the presence, primarily, of top and bottom members limit the application of such prior art tools to handgun slides with rear sights that do not exceed the spatial dimensions of the frame. A custom handgun slide or a slide configured for large caliber specifications may be too tall—especially when fitted with an elongate rear sight—to be used within such prior art tools. These prior art tools also impede a user's ability to use them with handgun slides which are presently fitted with externally mounted optical sighting devices or other hardware.

SUMMARY OF THE INVENTION

The present invention provides a simple apparatus for installing and/or removing a rear handgun sight without suffering from the same shortcomings as previously described. The present invention is capable of gripping the handgun slide and simultaneously applying both the requisite push contact and driving force directly in line with the resistance load of the rear sight. The handgun slide may be gripped using a wedge rather than multiple bolts or rods. The rear sight can be pushed by a generally longitudinal bit, such as a T-shaped bit or a cylindrical bit, which in turn, is incrementally urged by a drive screw. These features permit a user to precisely install and/or remove a rear handgun sight by contacting the rear sight in an optimal place. The rear sight may be incrementally moved, laterally, in order to more accurately align the sights, or it may be seamlessly removed from the handgun slide entirely without exerting needless forces or using crude tools which can damage the rear sight and the handgun slide.

Some embodiments of the present invention also do not possess a conventional frame which permits handgun slides and rear sights of all heights and dimensions to be used therewith. The lack of a conventional frame, as is commonly found in the art also allows for users to install, adjust, or remove rear sights from a handgun slide while the slide is fitted with ancillary optic devices. Conventional framed rear sight removal tools are cumbersome, and their framework makes any attempted use with a rear slide bearing an optic device or other externally mounted product impossible. Furthermore, the lack of a top member does not detract from the stability in which the handgun slide is gripped, as the wedge acts to completely secure the handgun slide within the tool.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
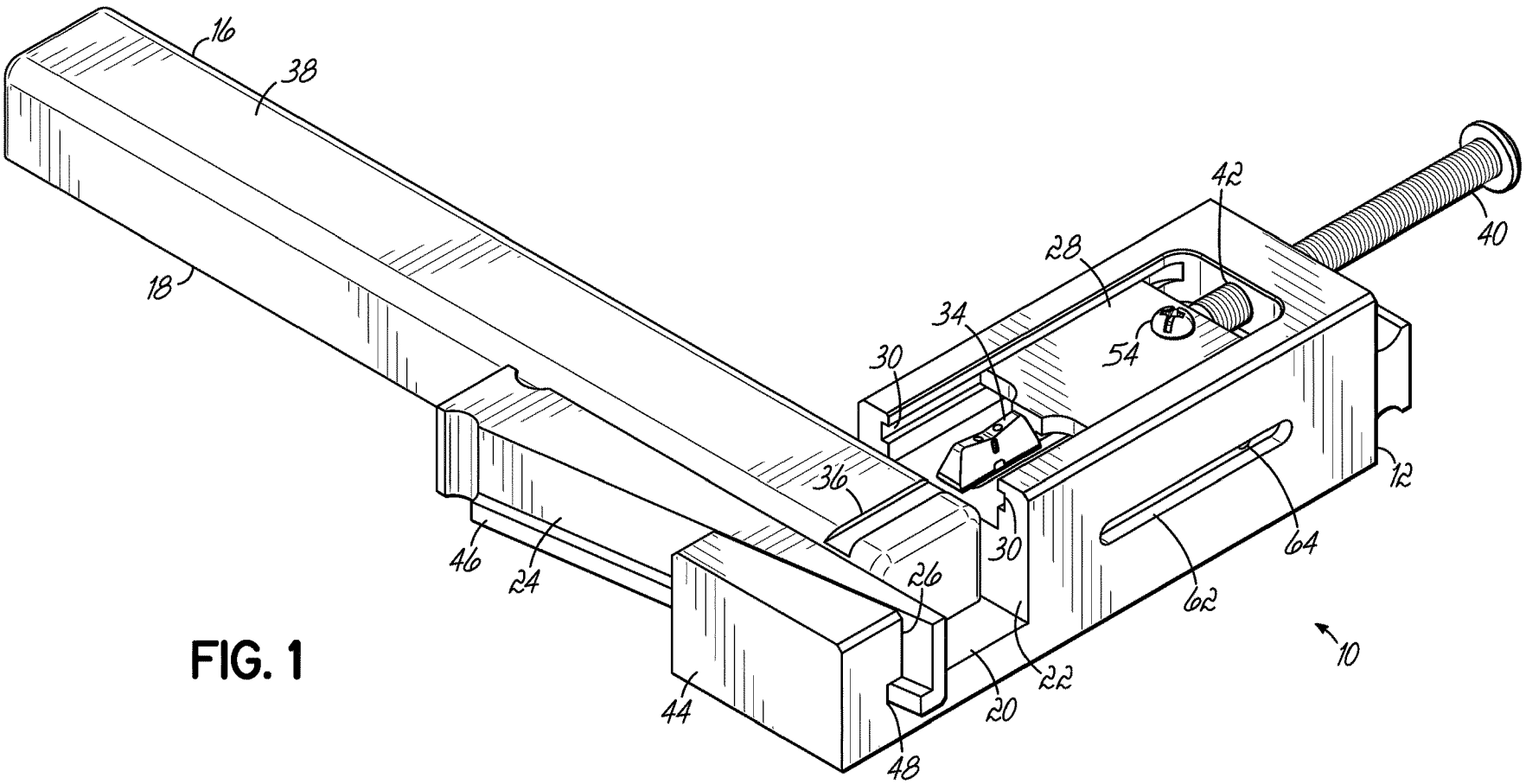
FIG. 1 is an isometric view of an embodiment of the present invention with a handgun slide mounted and a rear sight element partially installed.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. When referring to a firearm, "forward" will indicate the direction of the muzzle and the direction in which projectiles are fired, while "rearward" will indicate the opposite direction. "Lateral" or "transverse" indicates a side-to-side direction generally perpendicular to the axis of the barrel or to the longitudinal extension of the referenced part. Although firearms may be used in any orientation, "left" and "right" will generally indicate the sides according to the user's orientation, "top" or "up" will be the upward direction when the firearm is gripped, or the apparatus used in the ordinary manner.

Referring first to FIGS. 1-6, therein is shown a sight installation device 10 according to one embodiment of the present invention. As used herein, "sight installation device" shall be understood to refer generally to such a device that can be used to install, remove, and/or adjust sight elements that frictionally fit into a slotted opening in a handgun slide. The device 10 includes a base 12 that provides an elongated frame with a transverse slide-receiving notch 14. The notch 14 is oriented transversely relative to the length of the base.

A pistol slide 16 may be received in the notch 14 by orienting a bottom edge 18 of the slide against the floor 20 of the notch 14. The slide 16 may then be captured firmly against the first wall 22 of the notch 14 by insertion of a wedge 24 along the opposite side. The wedge 24 engages the angled second wall 26 of the notch 14 to firmly press or clamp the slide 16 against the first wall 22. The wide end of the wedge 24 can be tapped into place to secure the slide 16 by compression and the opposite end may be tapped to dislodge it. The wedge 24 can be made of a strong but non-marring material, such as a polymer material, if desired.

A pusher bit 28 is longitudinally slidable in the base in opposed guide channels 30. The pusher bit 28 includes a face 32 that is configured to abut and contact a sight element 34 directly in line with a sight-receiving dovetail groove 36 that is configured in the top surface 38 of the slide 18. The longitudinal position (relative to the base 12) of the pusher bit 28 is controlled by a drive screw 40 that engages a threaded opening 42 in the base 12.

Figure 2:
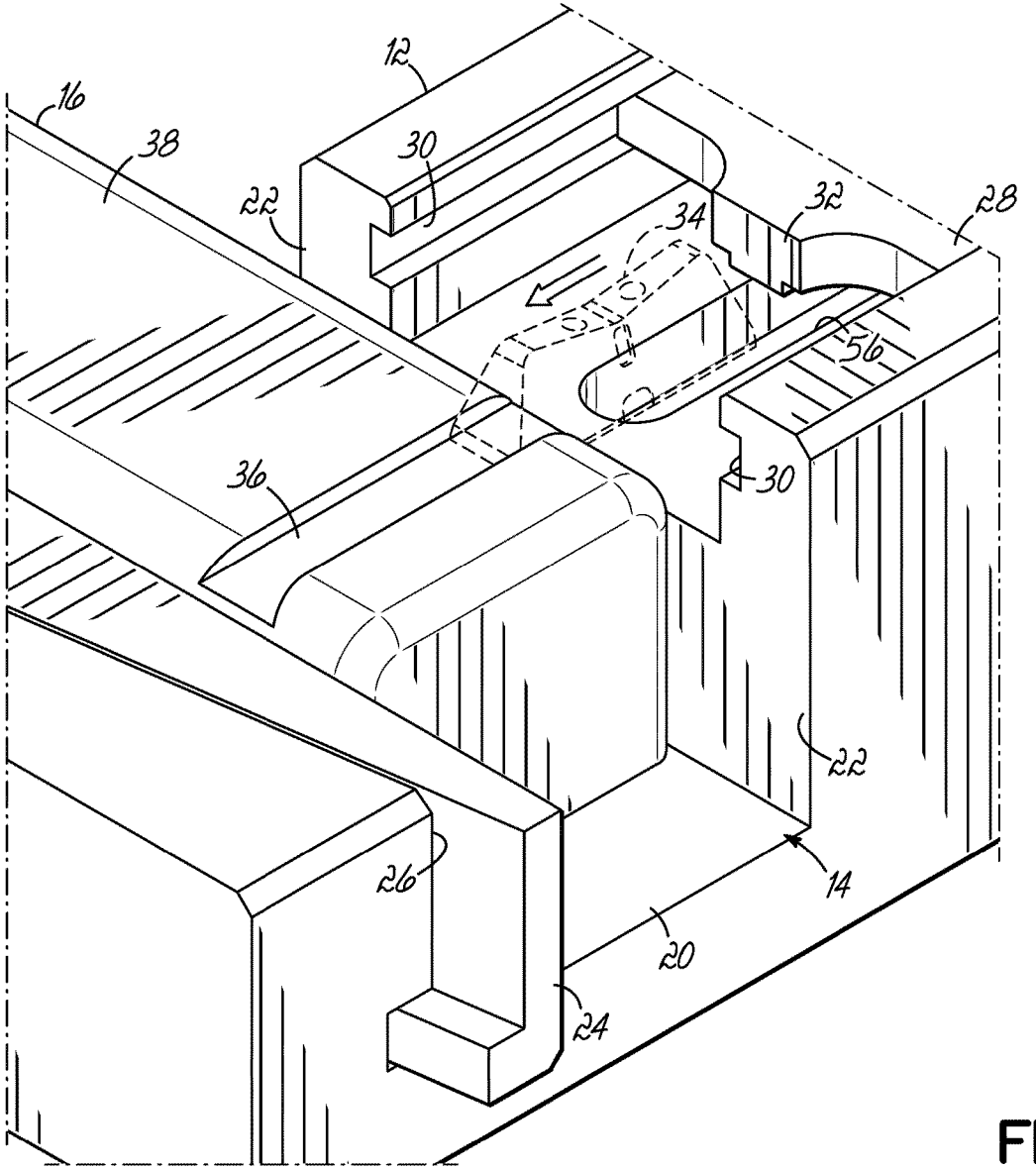
FIG. 2 is a close-up detail view with the sight element shown in phantom line so as not to obscure detail of the apparatus.

Referring now in particular to FIG. 2, it can be seen that the face 32 surface of the pusher bit 28 may include a generally T-shaped profile and may protrude forwardly of the remaining body of the bit 28. As will be described in more detail below, the pusher it 28 may be profiled in any other suitable manner of shapes. This allows contact that is directly in line with a bottom or base portion of the sight element 34 that engages the dovetail groove 36 in the slide 16. In the present embodiment, the lower leg of the T-shaped face 32, which may extend the full length of the pusher bit 28, will fit into and move through the dovetail groove 36 while the upper portion of the face 32 and remainder of the pusher bit 28 will pass over the top surface 38 of the slide 16. In this manner, as is the case for all embodiments of the present invention, both the driving force provided by the drive screw 40 and the pushing force of the pusher bit 28 are in line with the portion of the sight element 28 that is frictionally engaged in the dovetail groove 36. Because no part of the device 10 extends over the sight element 34, any height sights (including suppressor-height sights) may be installed/removed or adjusted without limitation. Additionally, handgun slides that bear externally mounted optical sighting devices or other externally mounted implements may be used due to the open nature of the notch. Furthermore, the absence of a moment arm created by proximate, competing force vectors within the sight element 34 reduces the amount of force needed to install and/or remove the sight element 34 and avoids threat of damage to the sight element 34 and/or groove 36.

Figure 3:
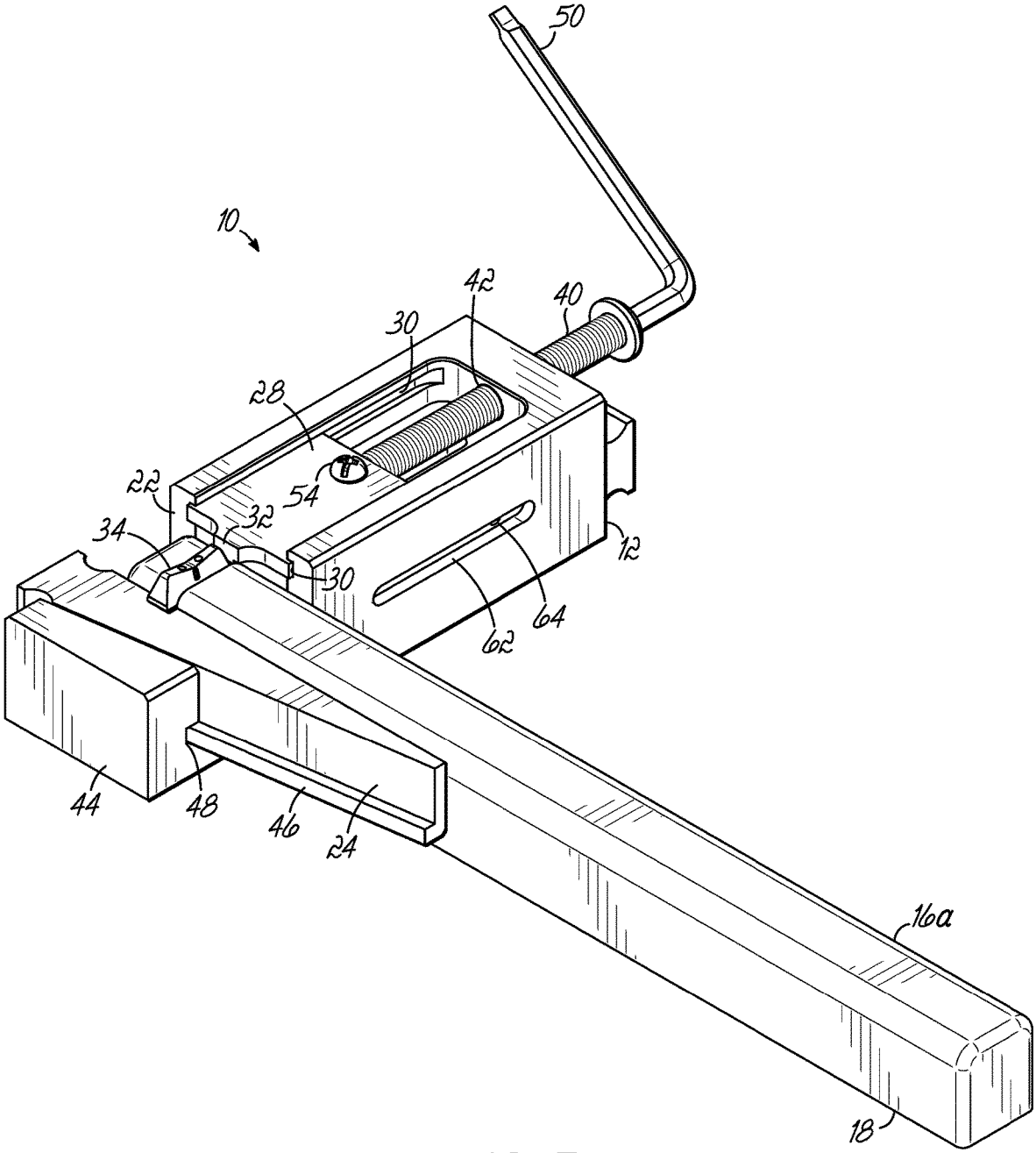
FIG. 3 is a similar view showing a different size slide in a reversed position and with a sight element partially removed.
Figure 4:
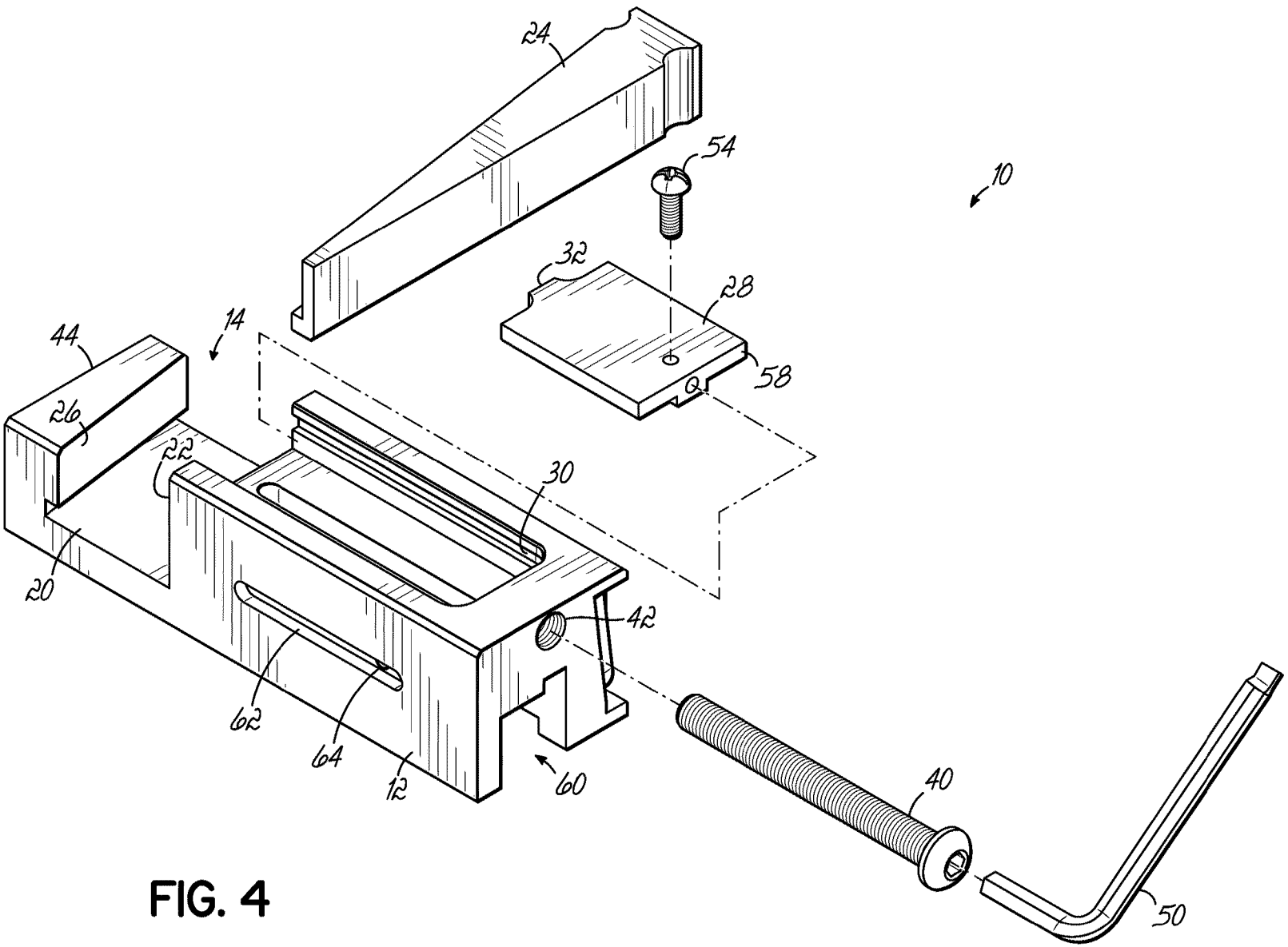
FIG. 4 is an isometric exploded view of an embodiment of the present invention.

Referring now in particular to FIG. 3, therein is shown an example of a different-sized slide 16*a* engaged in the notch 14 of the base 12 in a reversed position. Reversing the orientation of the slide 16, 16*a* allows the rear sight element 34 to be adjusted in the opposite direction. As can be seen, the inherent near-infinite adjustability of the wedge 24 allows slides 16, 16*a* of varying widths to be firmly and squarely gripped without the need for stabilizing bolts/rods and without the threat of over-compressing the slide 16, 16*a* to the point of damaging the slide 16, 16*a*. The illustrated device 10 is designed for slides 16, 16*a* of a specific height. However, the device may be designed for slides of other dimensions, or a shim (not shown) may be used under the slide to adjust its vertical position in the notch 14. The absence of a top member of the device 10—which in the prior art is used for securing the slide 16 through downward compression—makes the possible types of slides/sights used in connection with embodiments of the present invention unlimited.

Also as illustrated in FIG. 3, a slide element 34 may be removed by pushing it through/out of the dovetail groove 36. The height of the wedge 24 and upwardly extending tongue portion 44 of the base 12 is such that the sight element 34 and the entirety of the pusher bit 28 will pass over the wedge 24 and tongue portion 44 without interference. The wedge can be provided with a rail 46 that engages a channel 48 in the angled second wall 26 to control the vertical position of the wedge 24, assuring that it does not interfere with the sight element 34.

Figure 5:
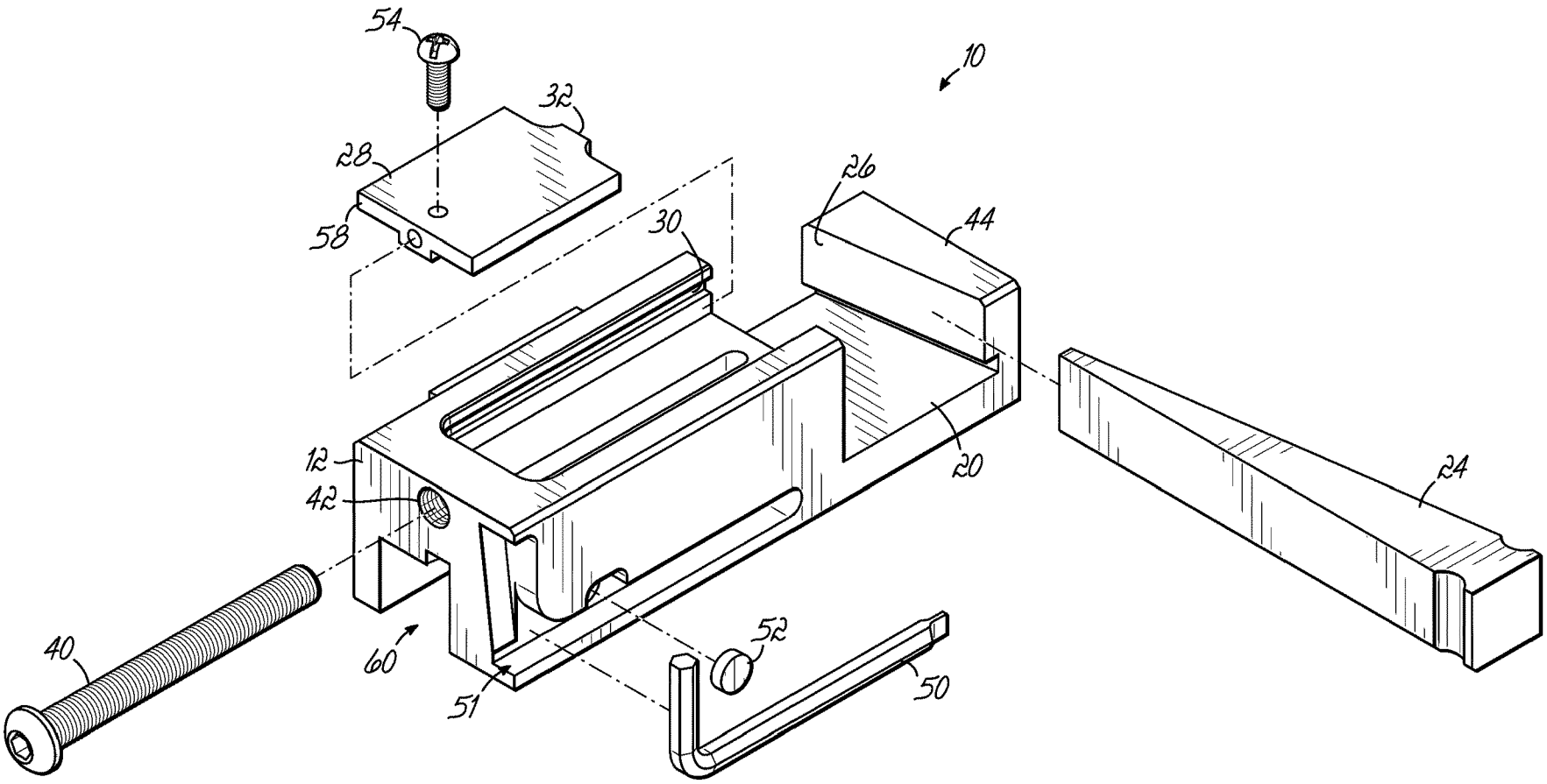
FIG. 5 is an alternate isometric exploded view thereof.
Figure 6:
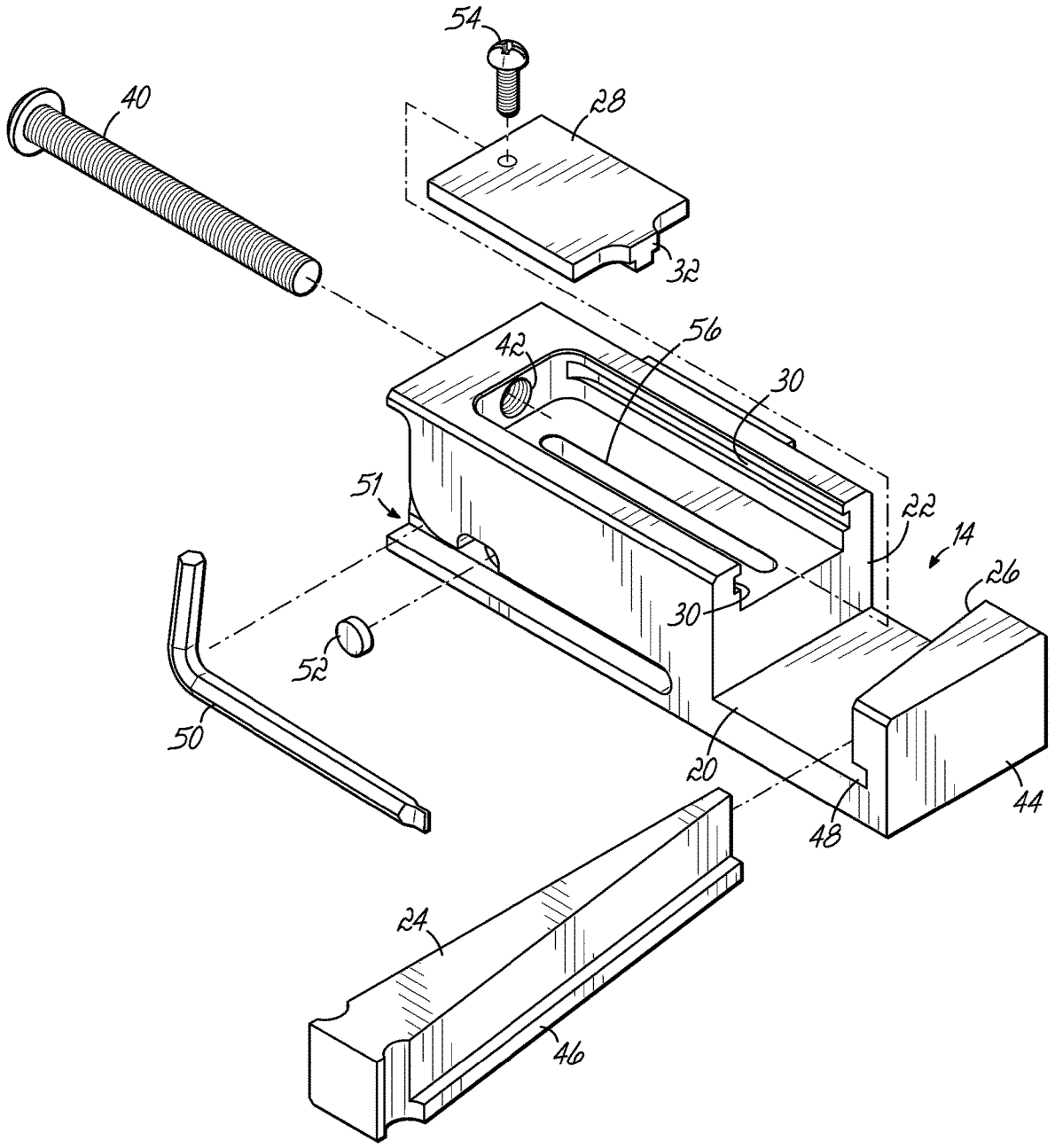
FIG. 6 is another alternate isometric exploded view thereof.

A tool 50 (such as a hex wrench) may be used to turn the drive screw 40. Using such a tool allows the user to provide controlled torque at highly gradual increments for turning the drive screw 40 and allows removal for compact storage. Alternatively, the drive screw 40 could be provided with a knob or wings (not shown) that allow a highly gradual manipulation of the drive screw 40. As illustrated in FIGS. 5 and 6, if desired, the base 12 may be provided with a recess 51 for receiving the tool 50 for storage. A small magnet 52 may be inset to removably retain the tool 50 in place. Alternatively, the recess 51 may be configured with securement flanges (not shown) which clip the tool 50 therein.

Also, if desired, the pusher bit 28 may be provided with an extension screw or fixed pin (not shown) that longitudinally engages in and slides along a guide groove 56 in the base 12. The extension of the screw 54 into the closed-end guide groove 56 prevents the pusher bit 28 from inadvertently being dislodged from the open ends of the guide channels 30 when not in use. In the illustrated embodiment, the drive screw 40 bears against a rear end surface 58 of the pusher bit 28, applying force in only one direction. If desired, the drive screw 40 could be adapted to be freely rotatably captive to the pusher bit 28 in a well-known manner. Additionally, position-indicating indicia (not shown) may be included on the base 12 and pusher bit 28 to reference relative movement on the sight element 34. Likewise, alignment indicia may be included on the top surface of the tongue portion 44 as a reference for placement of the dovetail groove 36 as the slide 16 is being positioned in the notch 14.

Figure 7:
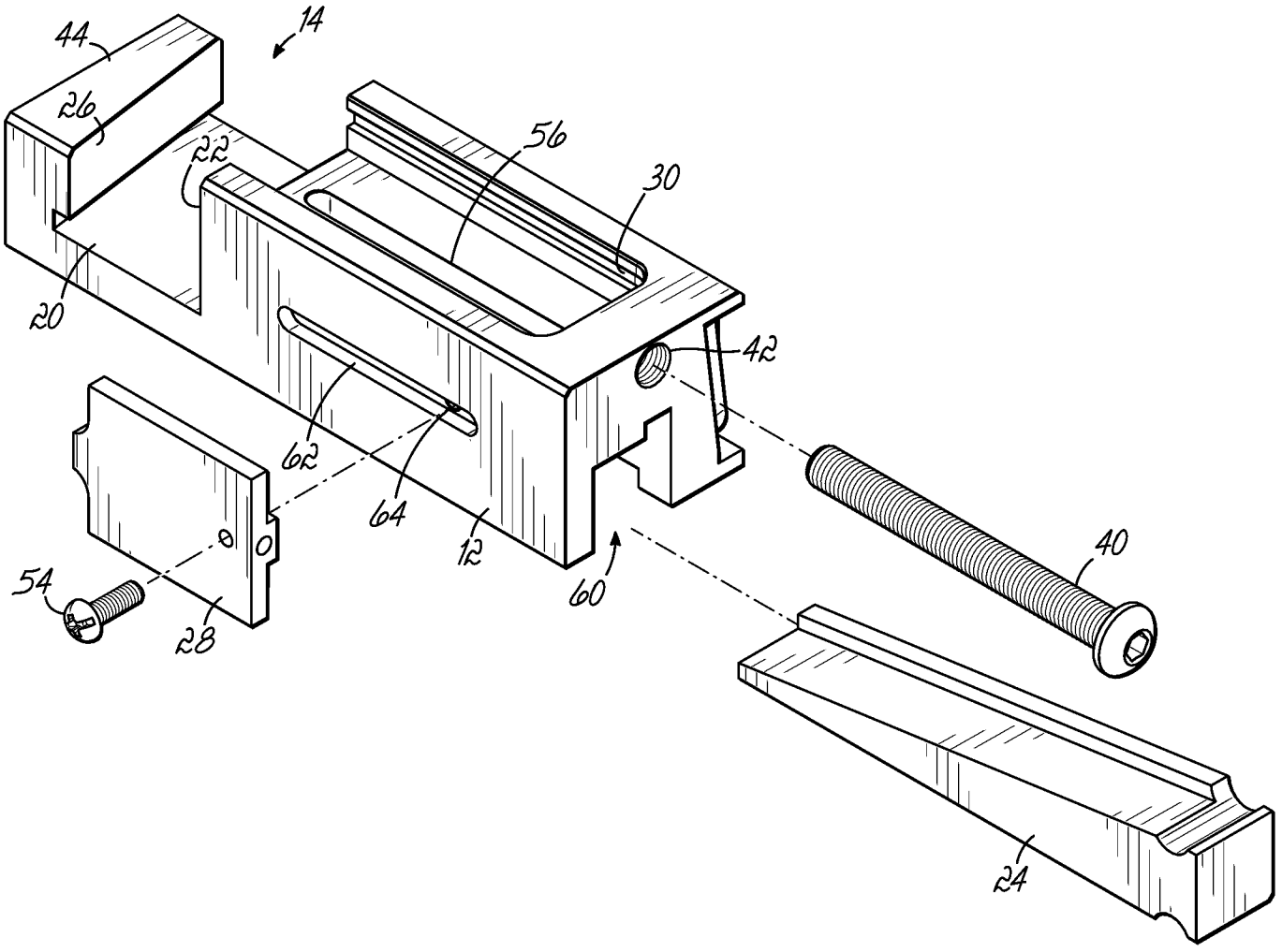
FIG. 7 is another isometric exploded view showing a parts storage feature.

Referring now to FIG. 7, the base 12 may include features that allow stowage of parts of the assembly when not in use. For example, the wedge 24 may be longitudinally inserted into a receiving chamber 60 formed on the bottom of the base 12. A storage groove 62 may be formed in a side wall of the base 12 to receive the lower leg of the T-shaped pusher bit 28. The pusher bit may be secured in place by using the screw 54 that can threadingly engage a corresponding threaded socket 64. The drive screw 40 may be stored simply by threading it all the way into the corresponding threaded opening 42 of the base 12. As previously described, the tool 50 may be removably stored as well.

Figure 8:
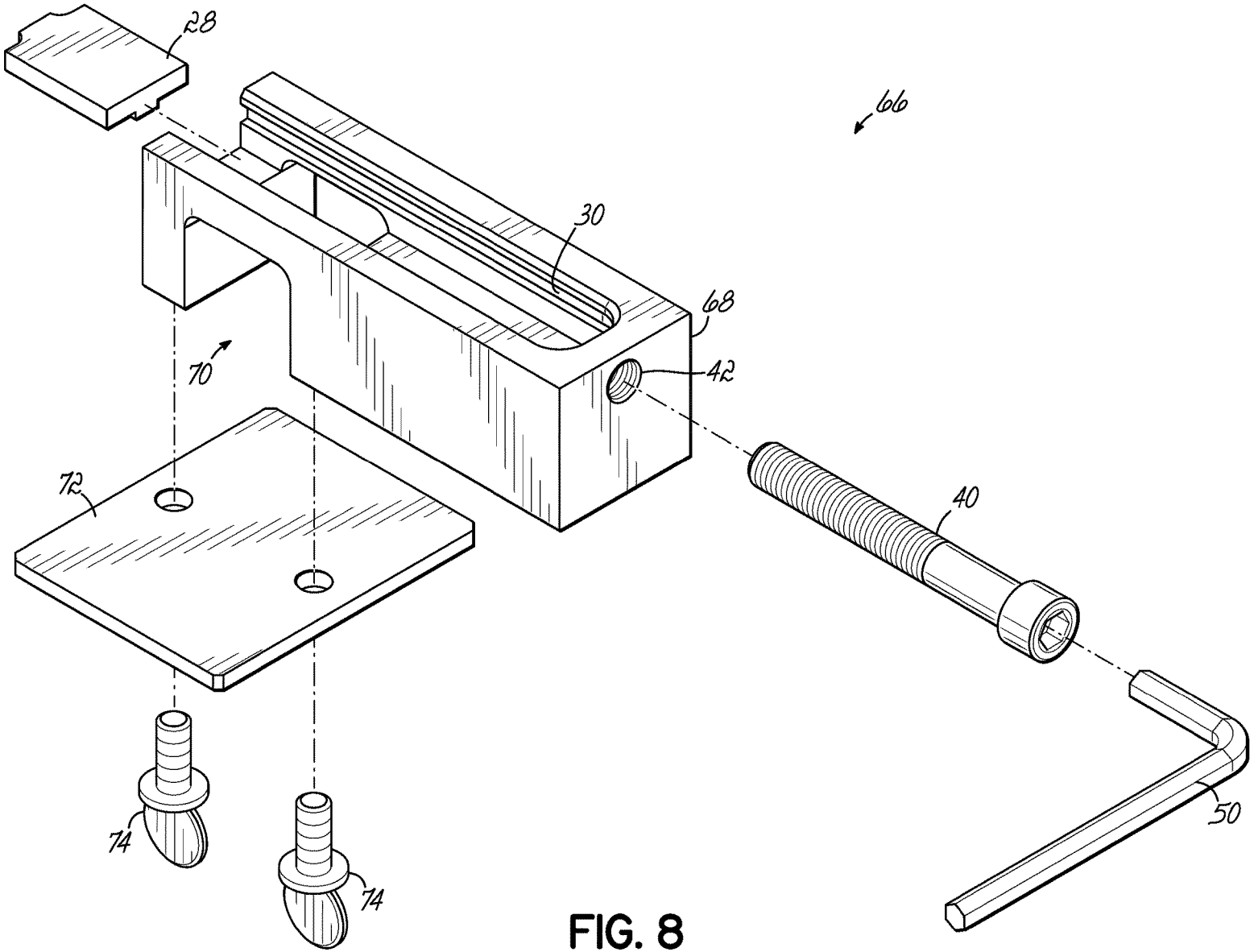
FIG. 8 is an isometric explodes view of an alternate embodiment.
Figure 9:
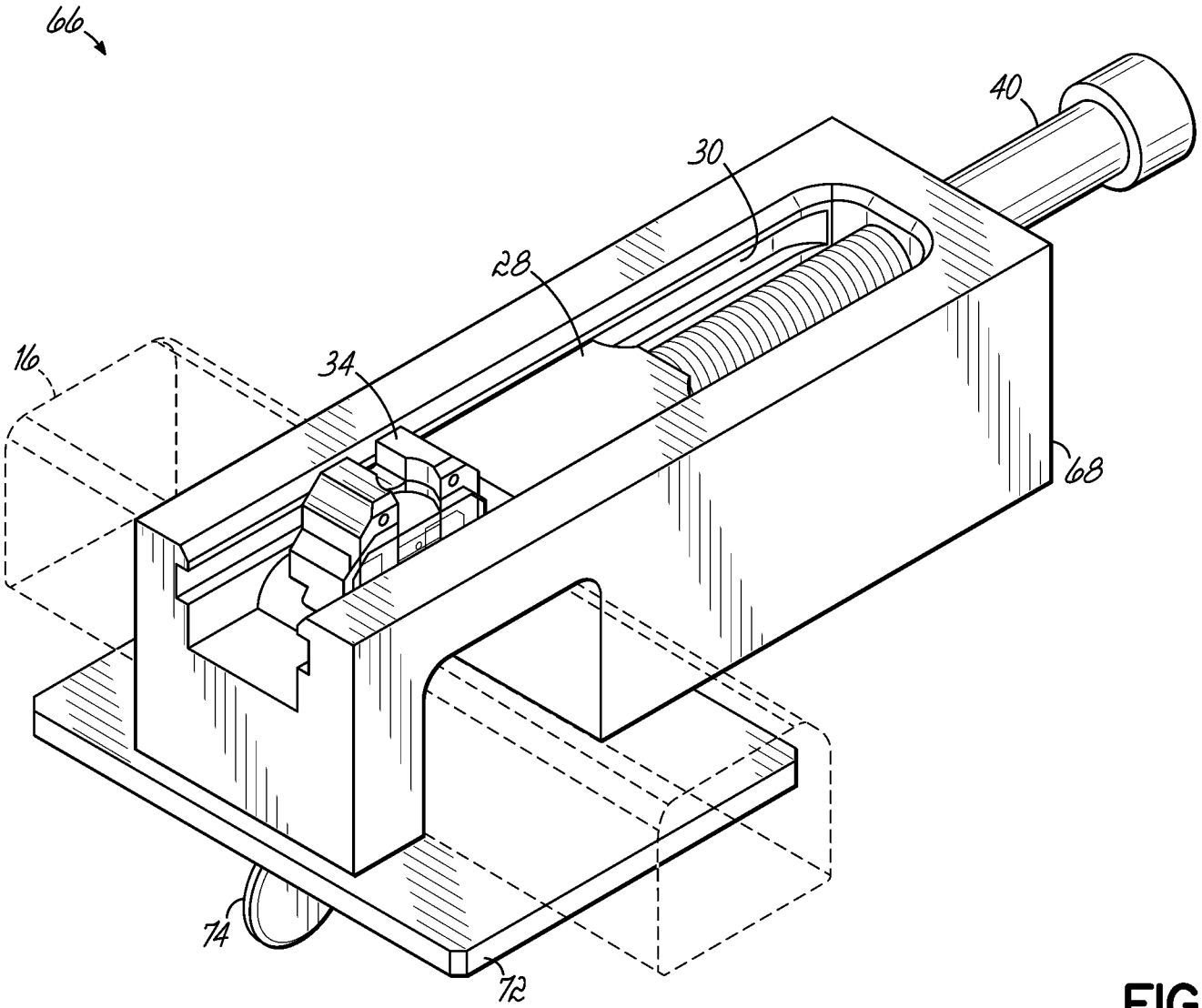
FIG. 9 is an assembled isometric view thereof showing a handgun slide is phantom line.

Referring now to FIGS. 8 and 9, therein is shown a sight installation device 66 according to another embodiment of the present invention. The device 66 includes a base 68 with longitudinal guide channels 30 that receive a pusher bit 28, as in the previously described embodiment. Likewise, a drive screw 40 engages a threaded opening 42 to drive the pusher bit 28. In this embodiment, there is a notch 70 transverse to the length of the base 68 configured to receive a portion of a pistol slide 16. In this embodiment the notch 70 is open to the bottom and the slide 16 is secured by compression in place with a mounting plate 72 which may be held in place by threaded fasteners 74. In this embodiment, sight elements 34 of any height may also be installed and the function of the pusher bit 28 is identical to that described above. In contrast to the previously described embodiment, rather than holding the slide 16 by lateral compression, it is held by vertical compression from the bottom against the horizontal abutment portions of the base 68 which extend over the top of the slide 16. However, unlike the prior art, the types of slides and sights available to be used with the presently described alternative embodiment are still not limited to certain slides/sights that fit within predetermined spatial limitations of the device 66. This is despite the presence of a putative top member, i.e., the notch 70 which is open to the bottom. The reason the presently described alternative embodiment is still not limited in the way the prior art tools are limited is because the open bottom of notch 70 permits slides/sights of all heights to fit therein, provided the threaded fasteners 74 are long enough to engage the mounting plate 72 and the device 66. Additionally, embodiments of the present invention permit the user to install, adjust and/or remove rear sights from handgun slides that possess or are presently fitted with optical sighting devices or externally mounted hardware. The open nature of the notch permits users to insert and secure handgun slides therewithin despite the presence of otherwise obstructive implements.

Figure 10:
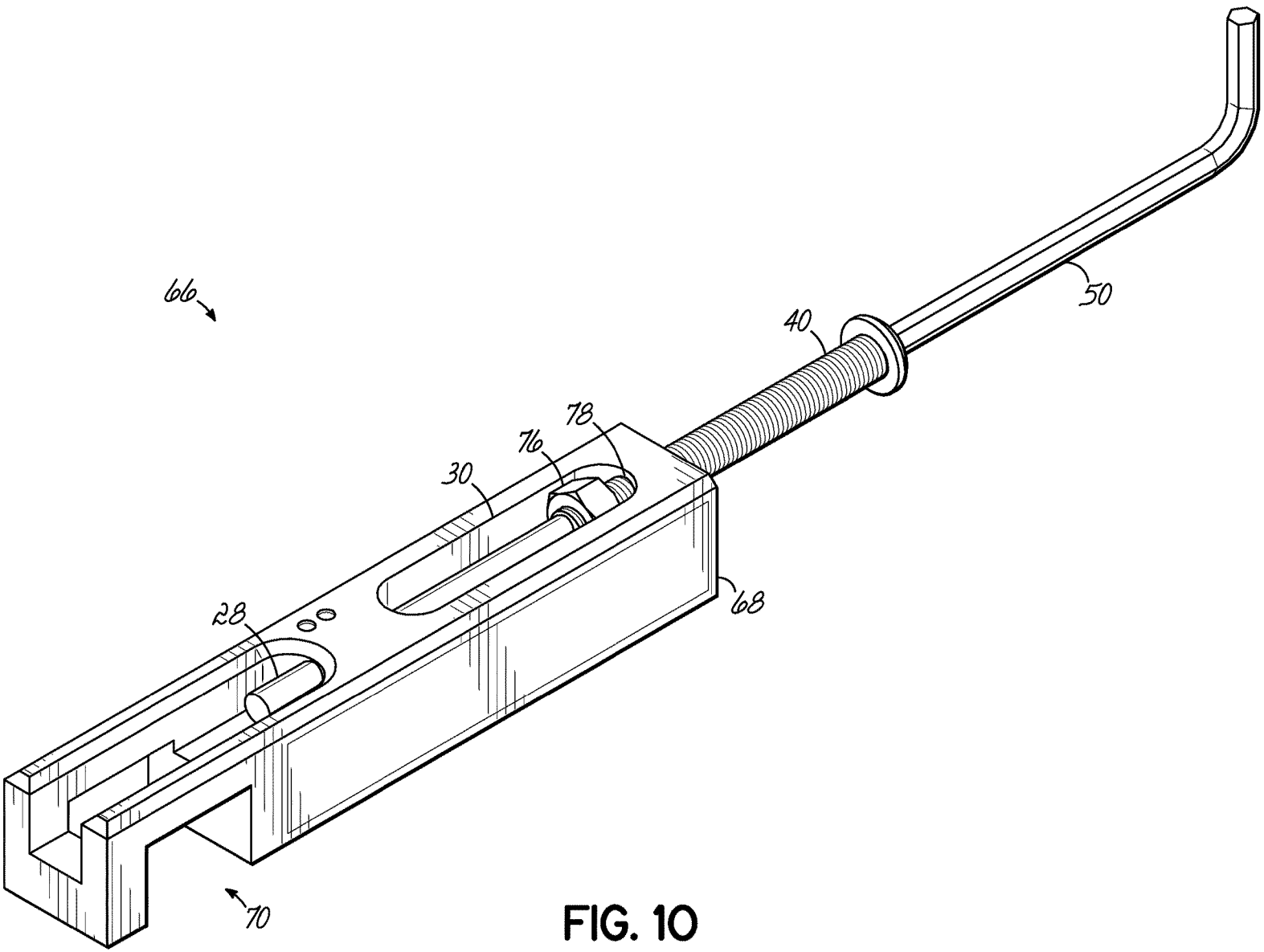
FIG. 10 is an assembled isometric view of an alternative embodiment.

FIG. 10 shows an alternative embodiment which is similar to the embodiment previously described in FIGS. 8 and 9. However, the embodiment shown in FIG. 10 differs slightly based on the shape of the pusher bit 28 and the incorporation of a drive nut 76. As is shown in FIG. 10, the drive screw 40 is inserted through a non-threaded opening 78, as opposed to a threaded opening. The drive nut 76 controls the degree to which the drive screw 40 may be urged forward. This is because the drive nut 76 is held in place by the walls of the longitudinal guide channel 30 and thus unable to rotate. The pusher bit 28, which is still contacted and urged forward in longitudinal guide channels 30 by the drive screw 40, is generally cylindrical. It should be noted that the pusher bit 28 may employ any other suitable shape. This embodiment shown in FIG. 10 possesses all the same features and benefits of the previously described embodiments of the present invention. While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A sight installation device, comprising:

a body having a notch which is capable of receiving a pistol slide with a sight receiving groove, the notch possessing a first and a second lateral sidewall, the sidewalls interconnected by structure without any interconnecting structure being positioned directly above the position of the sight receiving groove of the slide when the slide is received by the notch of the body, and an at least one horizontal base abutment;

the body also having at least one guide channel proximate the notch, in which a pusher bit is longitudinally slidable and configured so as to contact a sight element directly in line with the pistol slide's sight receiving groove; and a drive screw configured to engage an opening in the body proximate the guide channel, the drive screw engaging the opening and configured to engage the pusher bit, wherein the body is configured to receive the sight element spaced from the sight receiving groove, outside of the notch, and in abutment with the pusher bit prior to installation of the sight element in the pistol slide.

2. The sight installation device of claim 1, wherein the first and second lateral sidewalls are opposed.

3. The sight installation device of claim 1, wherein the at least first lateral sidewall includes a notch channel.

4. The sight installation device of claim 3, wherein a wedge includes a guide rail which is capable of transversely engaging the notch channel, the wedge being inserted into the notch to stabilize the pistol slide.

5. The sight installation device of claim 4, wherein the body includes a receiving chamber shaped to accept and stow the wedge.

6. The sight installation device of claim 5, wherein the receiving chamber is located on the bottom of the base opposite the notch.

7. The sight installation device of claim 1, wherein the pusher bit is generally T-shaped.

8. The sight installation device of claim 1, wherein the drive screw is turned by a hex tool.

9. The sight installation device of claim 8, wherein the body includes a recess configured to accept and stow the hex tool.

10. The sight installation device of claim 9, wherein the recess includes a magnet.

11. The sight installation device of claim 9, wherein the recess includes an at least one flange configured to retain the hex tool during stowage.

12. The sight installation device of claim 1, wherein the body includes a storage groove which is configured to accept and stow the pusher bit.

13. The sight installation device of claim 1, wherein the opening in the body is threaded.

14. The sight installation device of claim 1, wherein a drive nut is non-rotatably secured within the guide channel and capable of receiving and securing the drive screw.

15. A sight installation device, comprising:

a body having a notch which is capable of receiving a pistol slide with a sight receiving groove, the notch possessing a first and a second lateral sidewall, and an at least one horizontal base abutment;

the body also having at least one guide channel proximate the notch, in which a pusher bit is longitudinally slidable and configured so as to contact a sight element directly in line with the pistol slide's sight-receiving groove;

a drive screw configured to engage an opening in the body proximate the guide channel, the drive screw engaging the opening and configured to engage the pusher bit, wherein an extension screw longitudinally engages in and slides along the at least one guide channel.

16. A sight installation device for a pistol slide having a sight receiving groove, the device comprising:

a body having a fixed width notch with first and second lateral sidewalls and at least one guide channel proximate the notch, the notch configured to receive a pistol slide any a sight receiving groove can be aligned with the channel and the sidewalls interconnected by structure without that interconnecting structure being positioned above the position of the sight receiving groove of the slide when the slide is received by the notch of the body;

a pusher bit longitudinally slidable in the channel and having a portion configured to contact a sight element in line with the pistol slide's sight receiving groove;

a drive screw configured to threadingly engage an opening in the body and to engage the pusher bit to incrementally drive the pusher bit toward the sight receiving groove, wherein the body is configured to receive the sight element spaced from the sight receiving groove, outside of the notch, and in abutment with the pusher bit prior to installation of the sight element in the pistol slide.

17. The sight installation device of claim 16, wherein the structure interconnecting the sidewalls extends under the slide.

18. The sight installation device of claim 16, wherein the notch has a width greater the that of the slide, and further comprising a wedge insertable between the slide and one sidewall to secure the slide in the notch by pushing the slide against the other sidewall.

19. The sight installation device of claim 18, wherein one sidewall is angled relative to the other sidewall at an angle corresponding to an angle of the wedge.

20. The sight installation device of claim 16, wherein the structure interconnecting the sidewalls extends over the slide other than above the sight receiving groove.

21. The sight installation device of claim 20, wherein the slide secured in the notch by means pushing the slide up against the structure interconnecting the sidewalls.

* * * * *